US009574332B2

(12) United States Patent
Gilbert et al.

(10) Patent No.: US 9,574,332 B2
(45) **Date of Patent: *Feb. 21, 2017**

(54) FAUCET WITH WAND

(71) Applicant: Moen Incorporated, North Olmsted, OH (US)

(72) Inventors: Christopher Jon Gilbert, Moreland Hills, OH (US); Dale A. Pulver, Oberlin, OH (US)

(73) Assignee: Moen Incorporated, North Olmsted, OH (US)

( * ) Notice: Subject to any disclaimer, the term of this patent is extended or adjusted under 35 U.S.C. 154(b) by 80 days.

This patent is subject to a terminal disclaimer.

(21) Appl. No.: 14/275,023

(22) Filed: May 12, 2014

(65) Prior Publication Data

US 2014/0246107 A1 Sep. 4, 2014

Related U.S. Application Data

(63) Continuation of application No. 13/842,613, filed on Mar. 15, 2013, now Pat. No. 8,720,489.

(60) Provisional application No. 61/621,770, filed on Apr. 9, 2012.

(51) Int. Cl.
*E03C 1/04* (2006.01)

(52) U.S. Cl.
CPC ..... *E03C 1/0404* (2013.01); *E03C 1/04* (2013.01); *E03C 1/0412* (2013.01); *E03C 2001/0415* (2013.01); *Y10T 137/598* (2015.04); *Y10T 137/9464* (2015.04)

(58) Field of Classification Search
CPC ..... Y10T 137/9464; Y10T 137/598; E03C 1/0404; E03C 1/04; E03C 1/0412; E03C 2001/0415
USPC ..... 137/801
See application file for complete search history.

(56) References Cited

U.S. PATENT DOCUMENTS 5,822,811 A * 10/1998 Ko ..... E03C 1/0401 4/675
6,085,790 A * 7/2000 Humpert ..... B05B 1/1618 137/801
6,757,921 B2 * 7/2004 Esche ..... E03C 1/04 137/625.4
6,810,539 B2 * 11/2004 Bosio ..... E03C 1/04 4/675
7,909,269 B2 * 3/2011 Erickson ..... B05B 1/1618 137/801
8,720,489 B2 * 5/2014 Gilbert ..... E03C 1/0412 137/801
2006/0076056 A1 4/2006 Schmitt et al.
(Continued)

FOREIGN PATENT DOCUMENTS

CN 1521367 A 8/2004

OTHER PUBLICATIONS

Faucet Products, the faucet products shown in the cited document were publicly available prior to Mar. 15, 2013 (3 pages).
(Continued)

*Primary Examiner* — Jessica Cahill
*Assistant Examiner* — Daphne M Barry
(74) *Attorney, Agent, or Firm* — Calfee, Halter & Griswold LLP

(57) ABSTRACT

The present invention provides a faucet with a wand that has a geometric orientation of the wand and/or a geometric relationship between components of the faucet.

16 Claims, 15 Drawing Sheets

(56) References Cited

U.S. PATENT DOCUMENTS

| | | | | |
|---|---|---|---|---|
| 2008/0185060 | A1 | 8/2008 | Nelson | |
| 2011/0088784 | A1* | 4/2011 | Meehan | E03C 1/0404 137/1 |
| 2015/0191901 | A1* | 7/2015 | Kacik | E03C 1/0404 4/678 |

OTHER PUBLICATIONS

International Search Report for International App. No. PCT/US2013/035617 dated Jul. 9, 2013 (3 pages).
Written Opinion of the International Searching Authority for International App. No. PCT/US2013/035617 dated Jul. 9, 2013 (7 pages).
First Office Action issued by the State Intellectual Property Office of the People's Republic of China for Chinese App. No. 201380024622.1 dated Aug. 19, 2015 (17 pages).
Notification to Grant Patent Right issued by the State Intellectual Property Office of the People's Republic of China for Chinese App. No. 201380024622.1 dated May 10, 2016 (4 pages).

* cited by examiner

FAUCET WITH WAND

CROSS-REFERENCE TO RELATED APPLICATIONS

This application is a continuation application of U.S. Non-Provisional application Ser. No. 13/842,613, filed Mar. 15, 2013, the entire disclosure of which is hereby incorporated by reference, which claims the benefit of U.S. Provisional Application No. 61/621,770, filed Apr. 9, 2012, the entire disclosure of which is hereby incorporated by reference.

FIELD

The present invention relates generally to a faucet with a wand, and, more particularly, to a faucet with a wand that has a geometric orientation of the wand and/or a geometric relationship between components of the faucet.

BACKGROUND

Faucets with wands that can be pulled away from the faucets are well known. Such faucets are used in residential and commercial applications, such as in kitchens, laundry rooms, utility rooms, and various other locations. A faucet with a wand enables the user of the faucet to direct the flow of water from the faucet in a desired direction or at a desired location. Thus, the faucet can be more useful in certain applications.

Difficulties can be encountered in designing faucets with wands that are both functionally useful to the user and aesthetically pleasing to the user.

SUMMARY

The present invention provides a faucet with a wand that has a geometric orientation of the wand and/or a geometric relationship between components of the faucet.

In an exemplary embodiment, the faucet comprises a hub, a spout, an outlet, and a handle. The hub is operable to connect to a mounting surface. The spout includes a receptor and a wand. The receptor is operable to connect to the hub. The wand is operable to mount in the receptor. The wand is operable to pull away from the receptor. The spout has an upstream end, a downstream end, and a highest point between the upstream end and the downstream end. The spout has an interface between the receptor and the wand. The outlet is operable to deliver water from the wand. The handle is operable to connect to the hub. The handle is operable to move relative to the hub. The interface between the receptor and the wand is between the highest point of the spout and the downstream end of the spout. An angle of wand pull is less than ninety degrees. An angle of docked wand is greater than thirty degrees.

In another exemplary embodiment, the faucet comprises a hub, a spout, an outlet, and a handle. The hub is operable to connect to a mounting surface. The spout includes a receptor and a wand. The receptor is operable to connect to the hub. The wand is operable to mount in the receptor. The wand is operable to pull away from the receptor. The spout has an upstream end, a downstream end, and a highest point between the upstream end and the downstream end. The spout has an interface between the receptor and the wand. The outlet is operable to deliver water from the wand. The handle is operable to connect to the hub. The handle is operable to move relative to the hub. The interface between the receptor and the wand is between the highest point of the spout and the downstream end of the spout. An angle of wand pull is greater than sixty degrees. An angle of docked wand is less than sixty degrees.

In another exemplary embodiment, the faucet comprises a hub, a receptor, a wand, an outlet, and a handle. The hub is operable to connect to a mounting surface. The receptor is operable to connect to the hub. The wand is operable to mount in the receptor. The wand is operable to pull away from the receptor. The outlet is operable to deliver water from the wand. The handle is operable to connect to the hub. The handle is operable to move relative to the hub. An angle of wand pull is less than ninety degrees and greater than sixty degrees. An angle of docked wand is less than sixty degrees and greater than thirty degrees.

In another exemplary embodiment, the faucet comprises a hub, a spout, an outlet, and a handle. The hub is operable to connect to a mounting surface. The spout includes a receptor and a wand. The receptor is operable to connect to a side of the hub. The wand is operable to mount in the receptor. The wand is operable to pull away from the receptor. The spout has an upstream end, a downstream end, and a highest point between the upstream end and the downstream end. The spout has an interface between the receptor and the wand. The outlet is operable to deliver water from the wand. The handle is operable to connect to a top of the hub. The handle is operable to move relative to the hub. The interface between the receptor and the wand is between the highest point of the spout and the downstream end of the spout. An angle of wand pull is less than ninety degrees.

DETAILED DESCRIPTION

The present invention provides a faucet with a wand that has a geometric orientation of the wand and/or a geometric relationship between components of the faucet.

Figure 1:
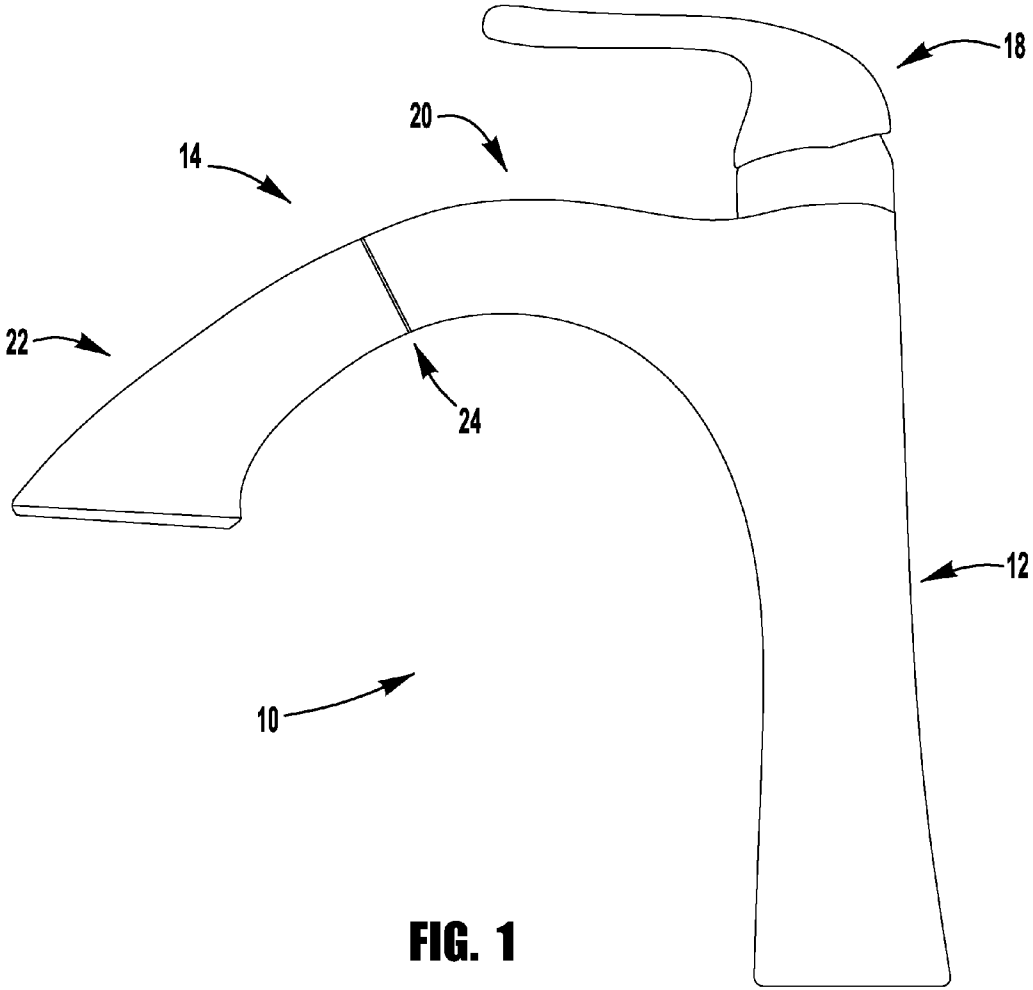
FIG. 1 is a right side elevational view of a faucet with a wand according to a first exemplary embodiment of the present invention.
Figure 4:
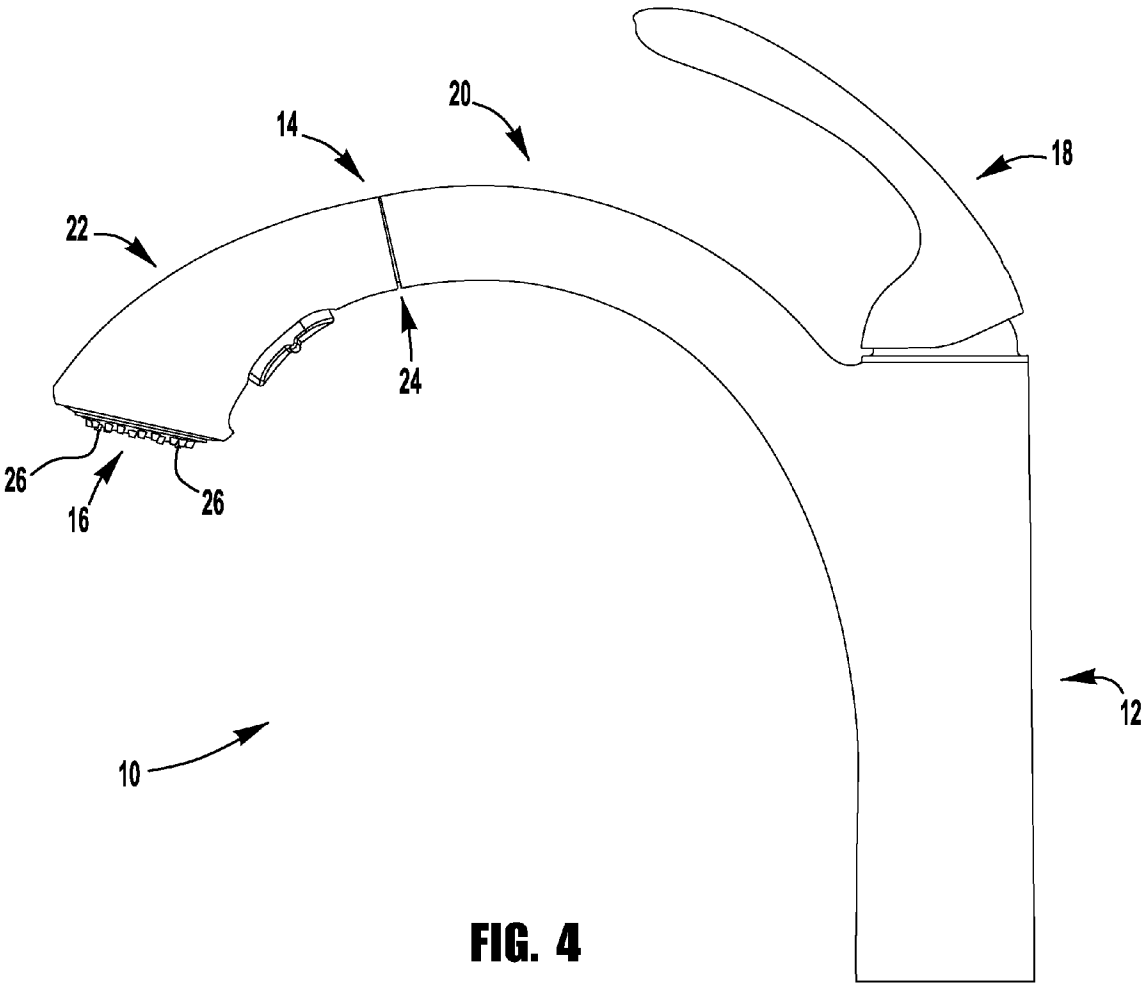
FIG. 4 is a right side elevational view of a faucet with a wand according to a second exemplary embodiment of the present invention.
Figure 7:
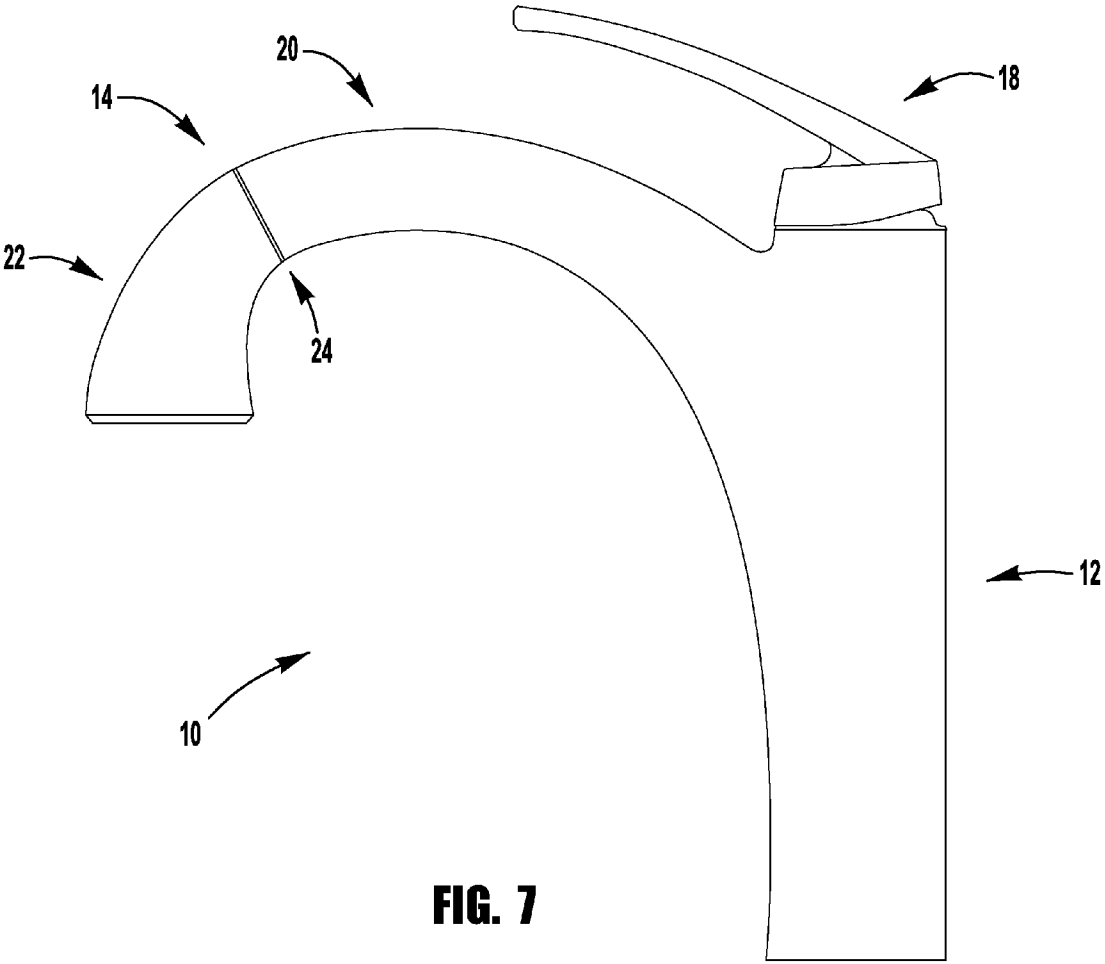
FIG. 7 is a right side elevational view of a faucet with a wand according to a third exemplary embodiment of the present invention.
Figure 10:
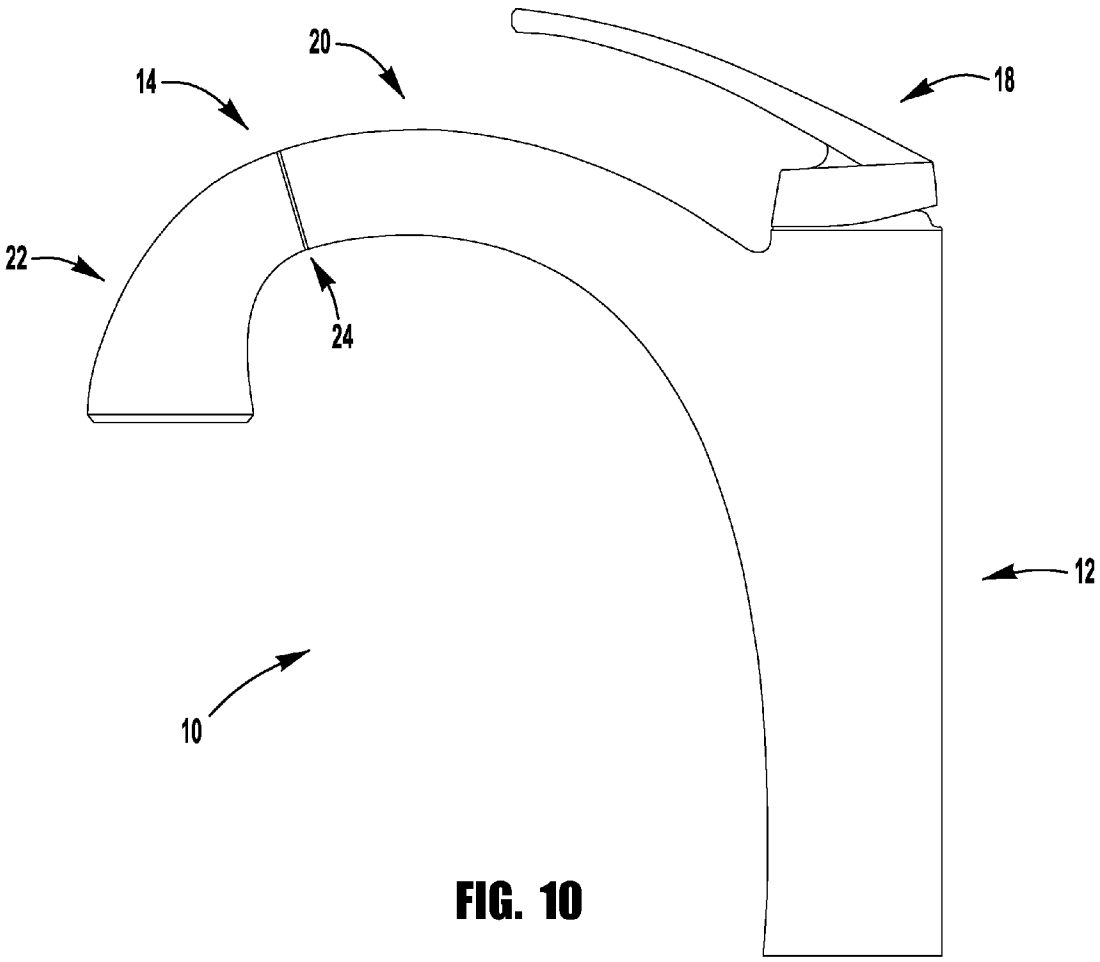
FIG. 10 is a right side elevational view of a faucet with a wand according to a fourth exemplary embodiment of the present invention.
Figure 13:
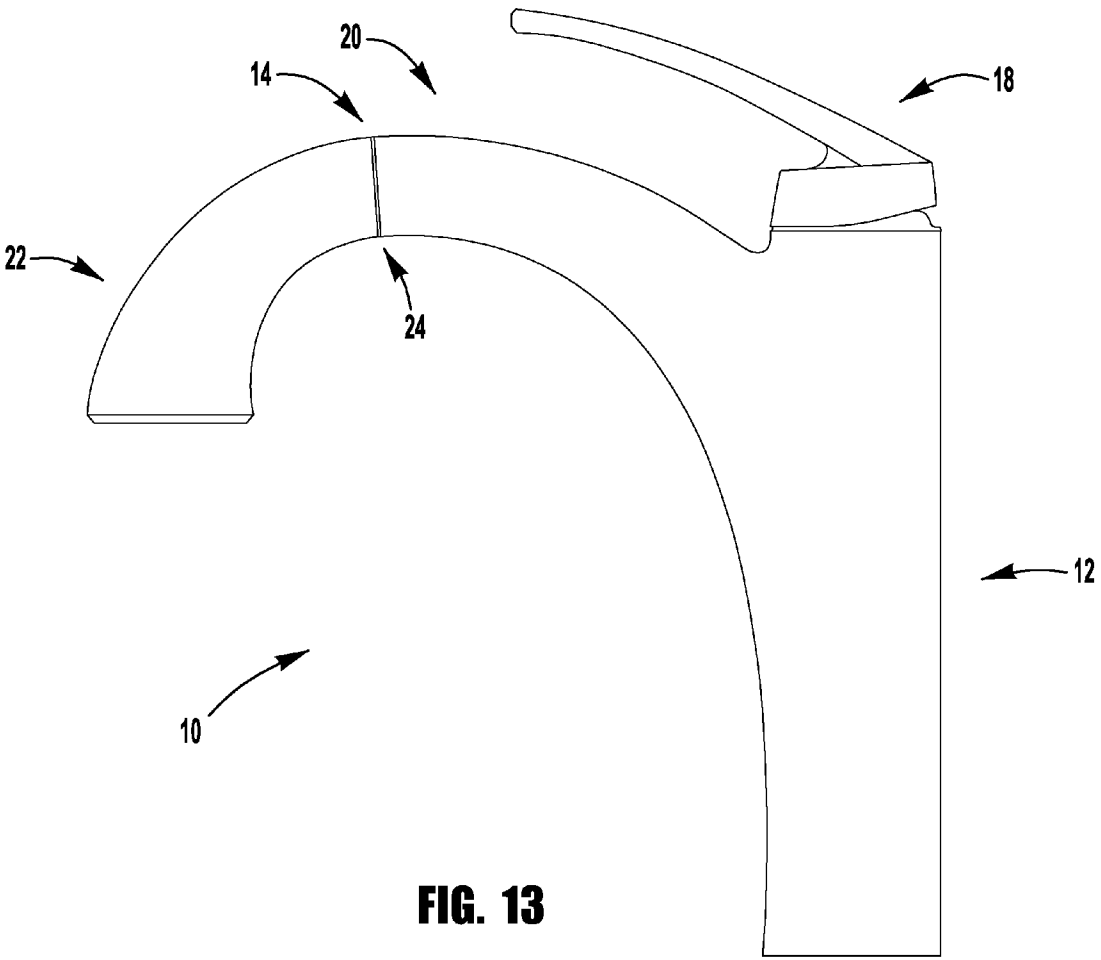
FIG. 13 is a right side elevational view of a faucet with a wand according to a fifth exemplary embodiment of the present invention.

An exemplary embodiment of a faucet 10 of the present invention is shown in FIGS. 1, 4, 7, 10, and 13. As illustrated, the faucet 10 includes a hub 12, a spout 14, a spray face 16, and a handle 18. The spout 14 includes a receptor 20, a wand 22, and an interface 24 between the receptor 20 and the wand 22. The spray face 16 includes an outlet (or a plurality of outlets) 26. As used herein, the term "outlet" will refer to a single outlet or a plurality of outlets. A base of the hub 12 is connected to a mounting surface (such as a counter or sink). An upstream end of the receptor 20 is connected to the hub 12. In an exemplary embodiment, the upstream end of the receptor 20 is connected to a side of the hub 12. In an exemplary embodiment, the upstream end of the receptor 20 is connected to a top of the hub 12. An upstream end of the wand 22 is mounted in a downstream end of the receptor 20. The wand 22 is operable to pull away from the receptor 20. The spray face 16 is mounted in a downstream end of the wand 22. In certain embodiments, all or a portion of the spray face 16 is inside the downstream end of the wand 22 and, thus, is not visible from outside the wand 22. The outlet 26 is operable to deliver water from the wand 22. The handle 18 is connected to the hub 12. In an exemplary embodiment, the handle 18 is connected to the top of the hub 12. In an exemplary embodiment, the handle 18 is connected to a side of the hub 12. The handle 18 is operable to move relative to the hub 12.

Figure 2:
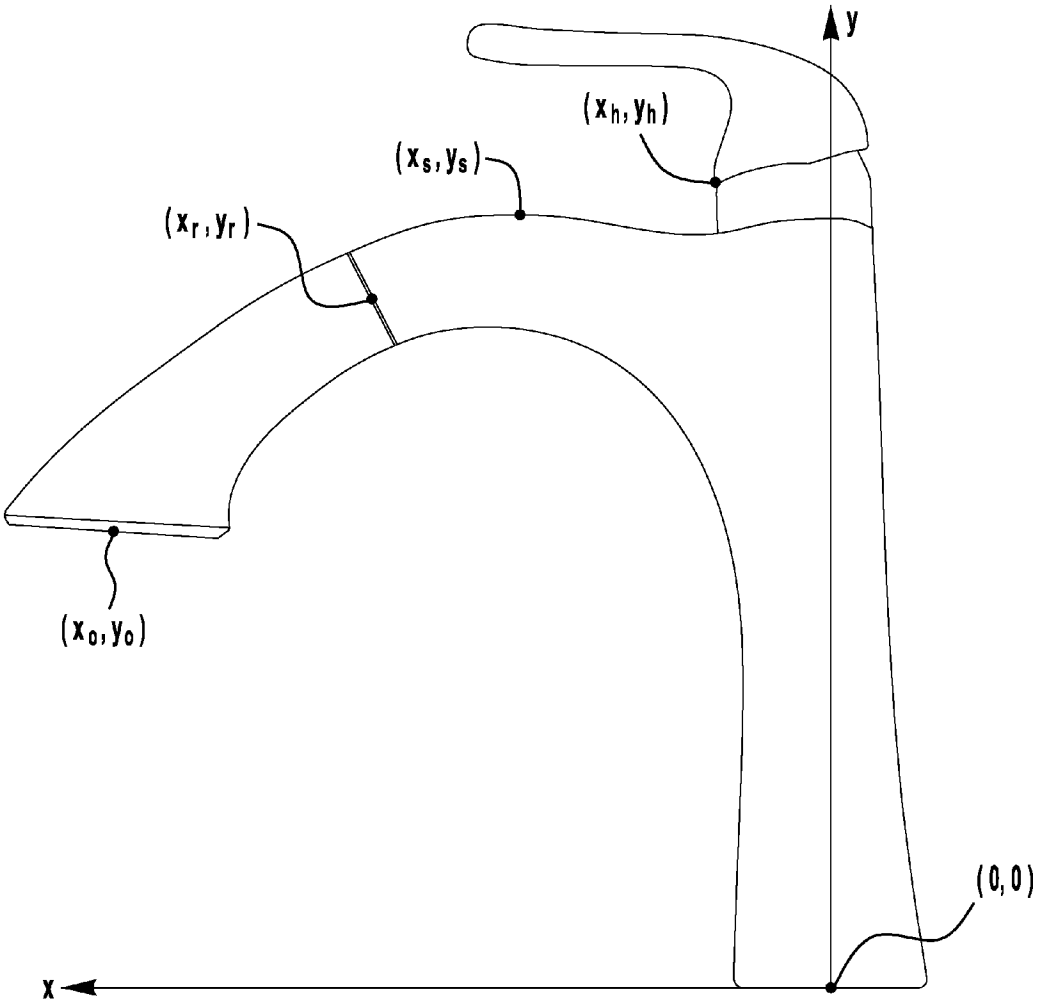
FIG. 2 is the side elevational view of FIG. 1 showing reference points for a geometric orientation of the wand and/or a geometric relationship between components of the faucet.
Figure 3:
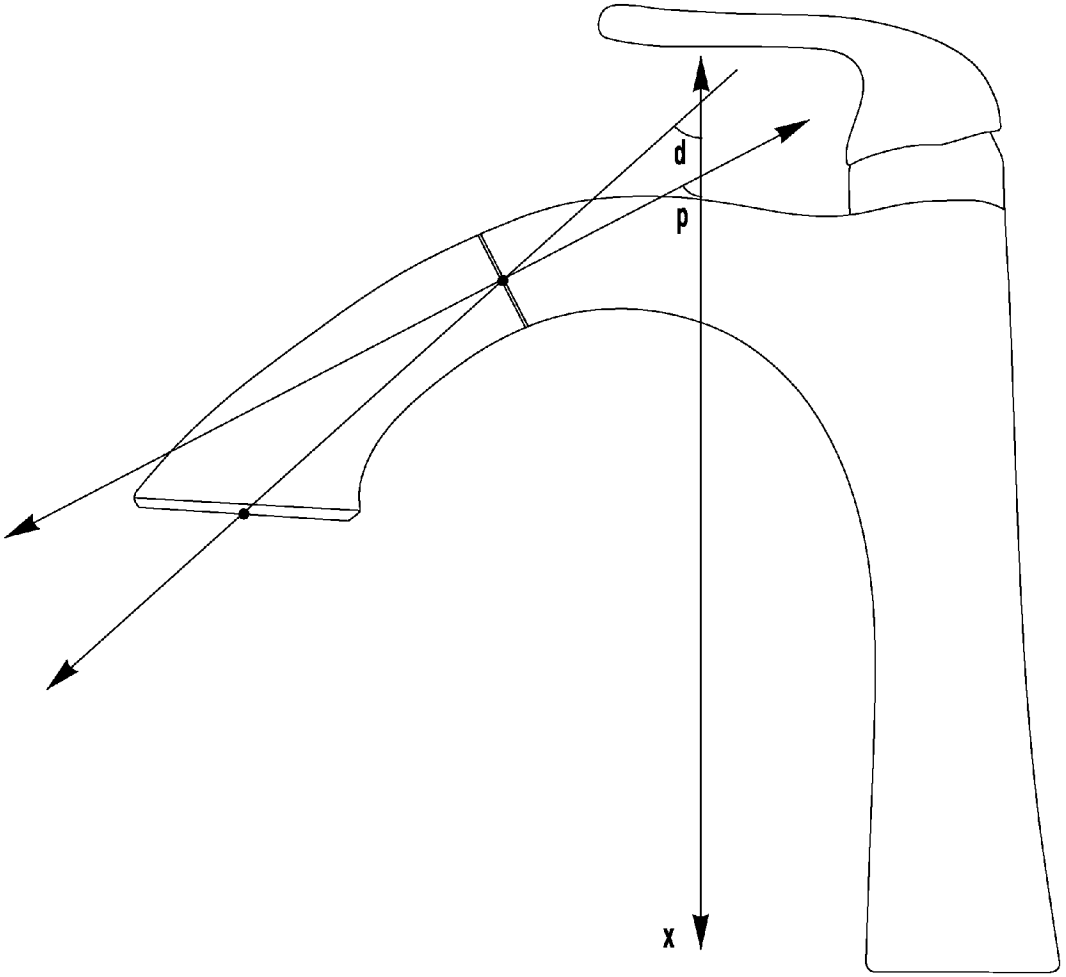
FIG. 3 is the side elevational view of FIG. 1 showing reference angles for a geometric orientation of the wand and/or a geometric relationship between components of the faucet.
Figure 5:
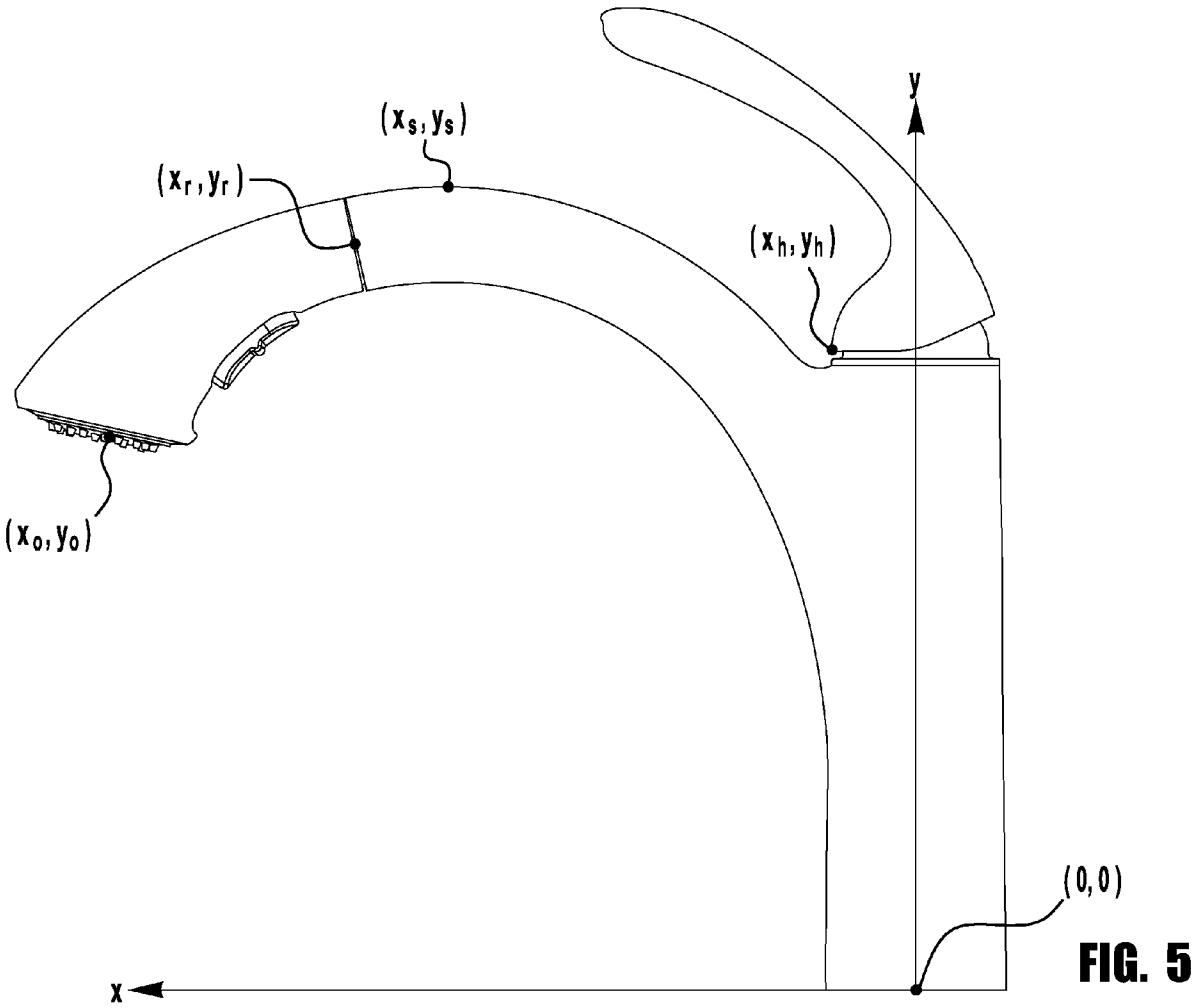
FIG. 5 is the side elevational view of FIG. 4 showing reference points for a geometric orientation of the wand and/or a geometric relationship between components of the faucet.
Figure 6:
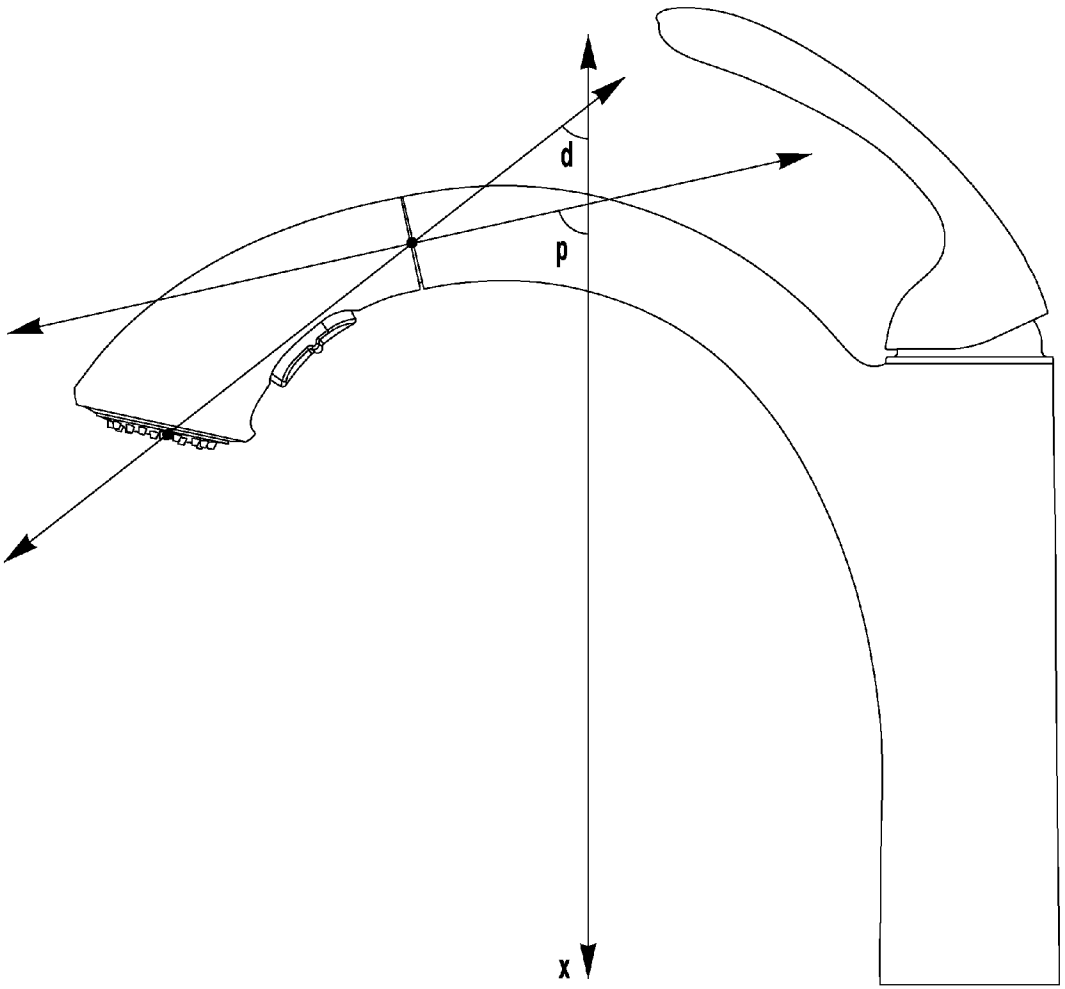
FIG. 6 is the side elevational view of FIG. 4 showing reference angles for a geometric orientation of the wand and/or a geometric relationship between components of the faucet.
Figure 8:
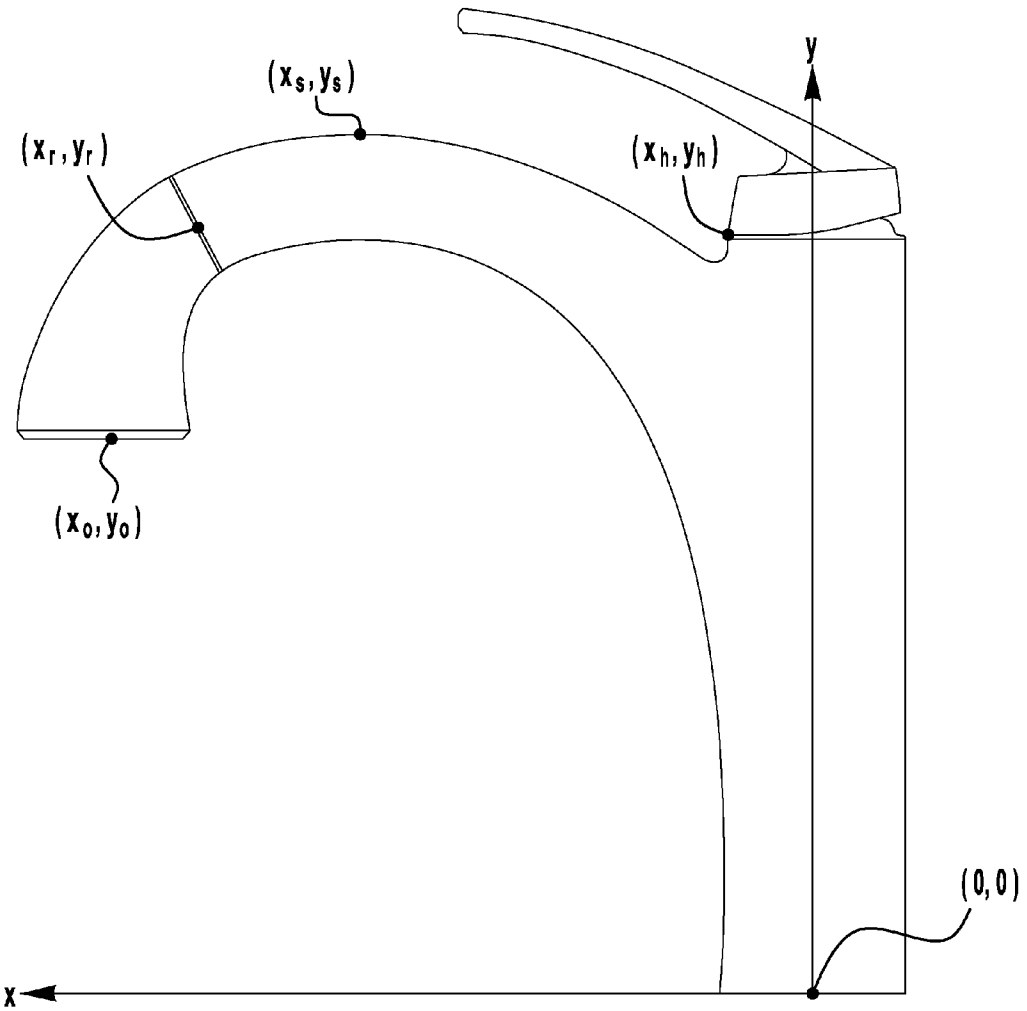
FIG. 8 is the side elevational view of FIG. 7 showing reference points for a geometric orientation of the wand and/or a geometric relationship between components of the faucet.
Figure 9:
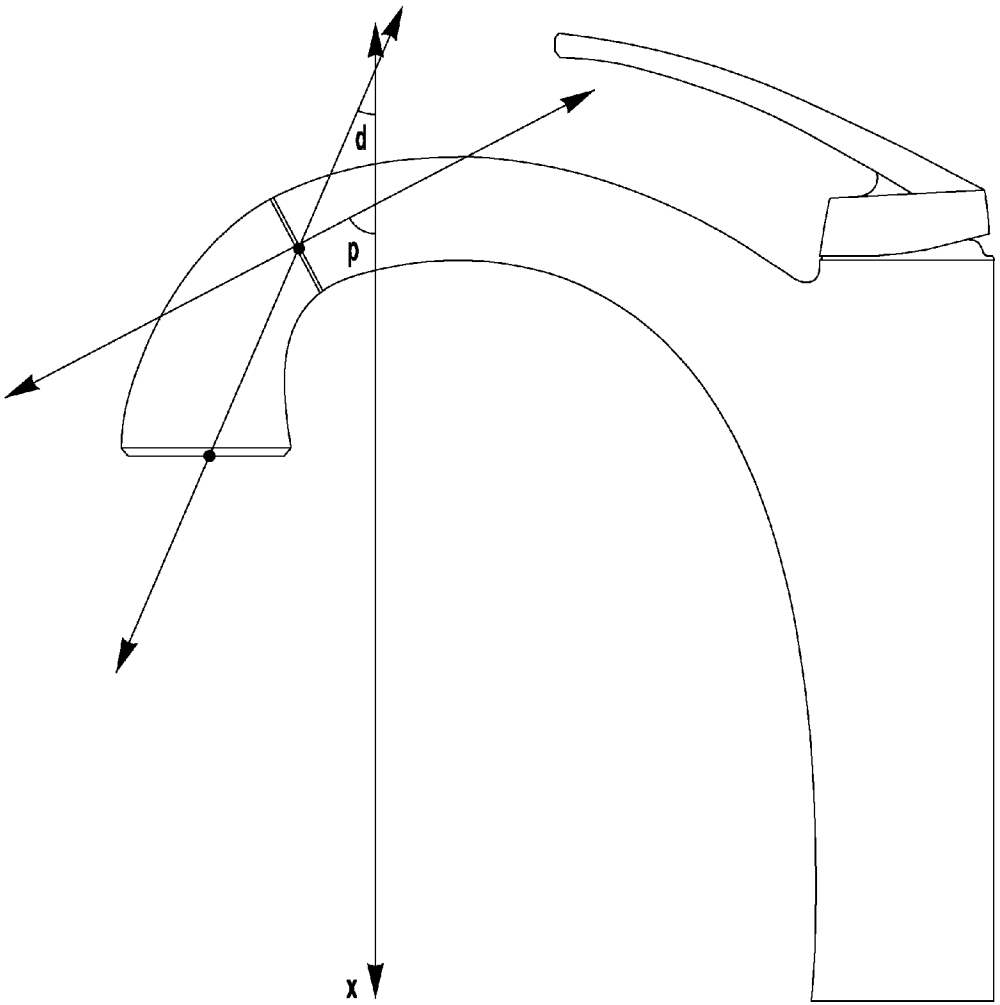
FIG. 9 is the side elevational view of FIG. 7 showing reference angles for a geometric orientation of the wand and/or a geometric relationship between components of the faucet.
Figure 11:
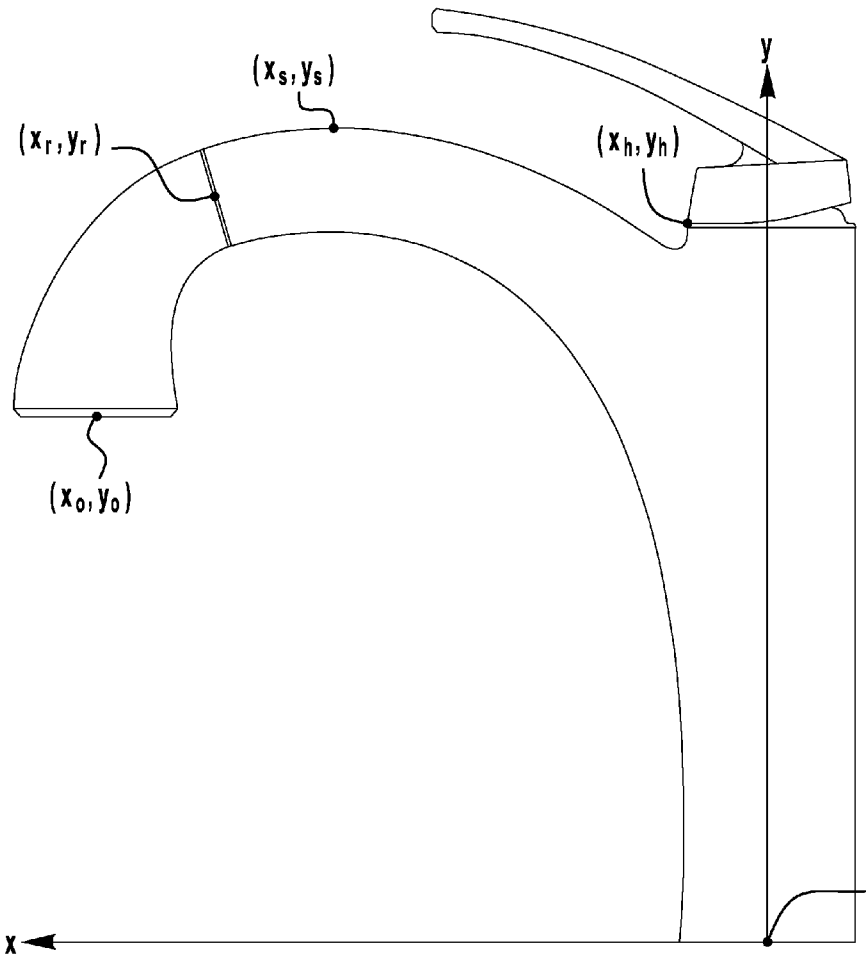
FIG. 11 is the side elevational view of FIG. 10 showing reference points for a geometric orientation of the wand and/or a geometric relationship between components of the faucet.
Figure 12:
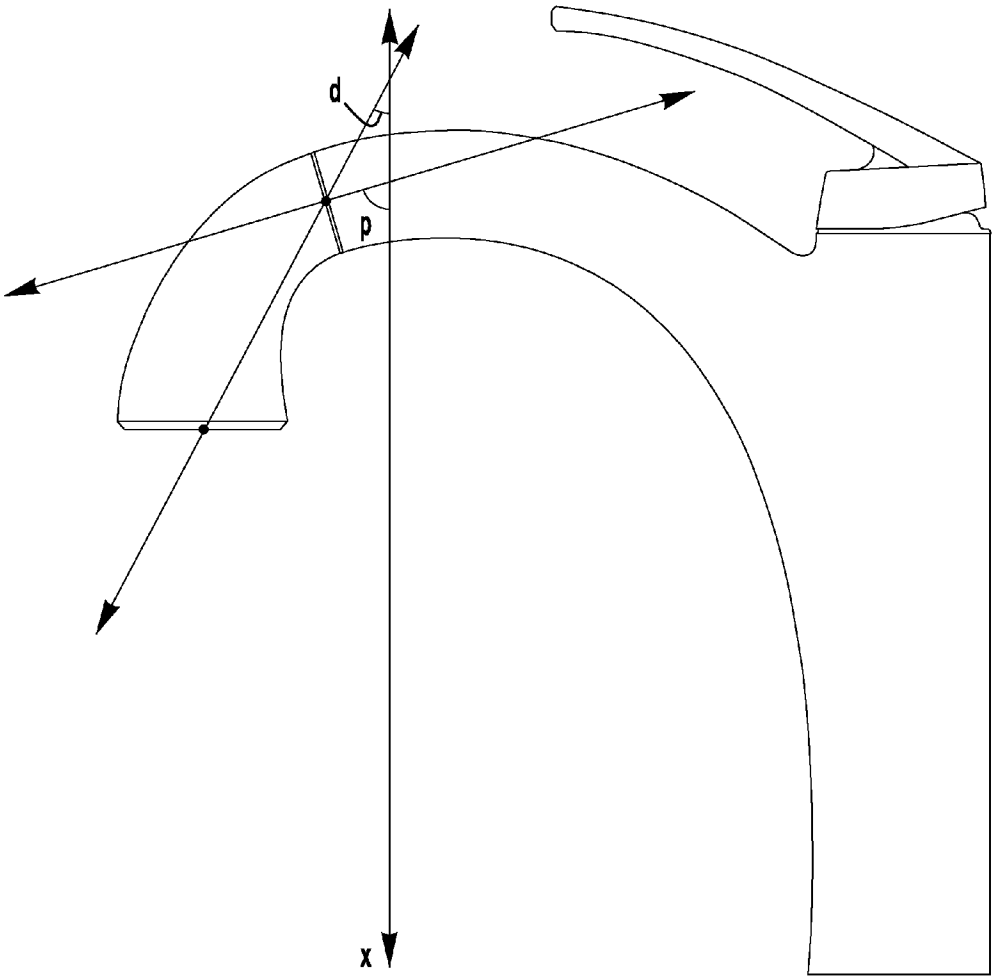
FIG. 12 is the side elevational view of FIG. 10 showing reference angles for a geometric orientation of the wand and/or a geometric relationship between components of the faucet.
Figure 14:
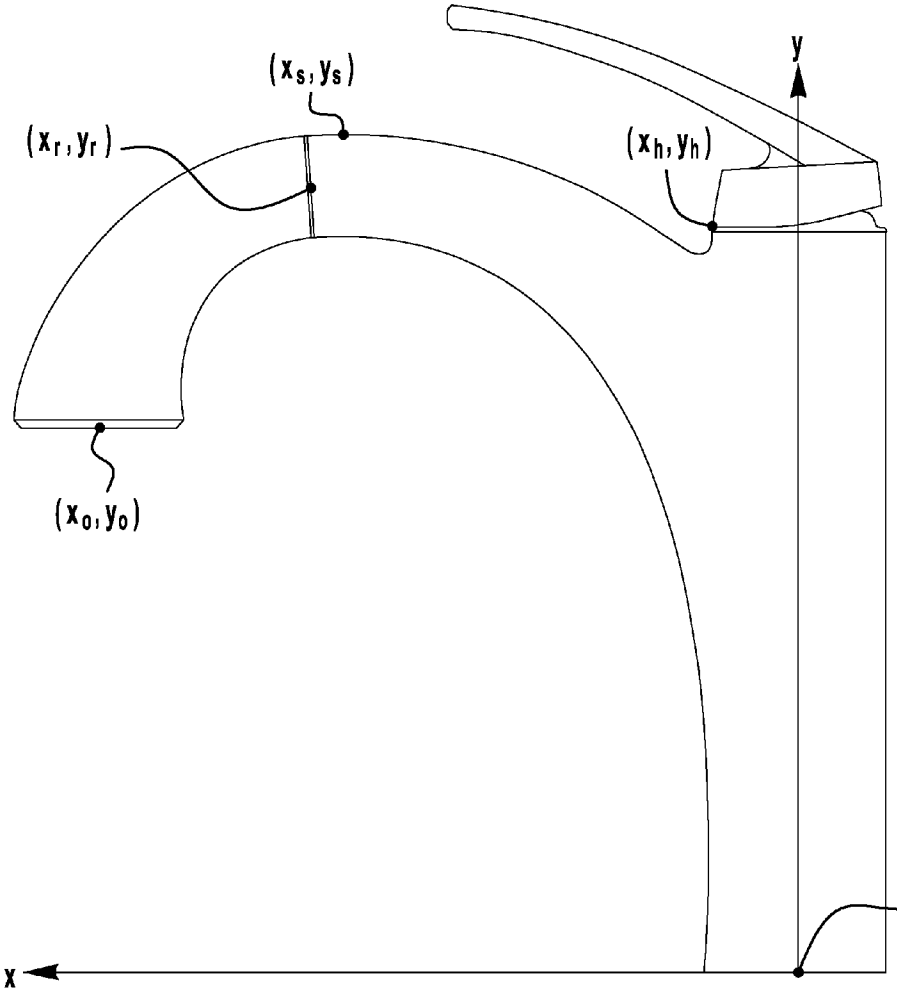
FIG. 14 is the side elevational view of FIG. 13 showing reference points for a geometric orientation of the wand and/or a geometric relationship between components of the faucet.
Figure 15:
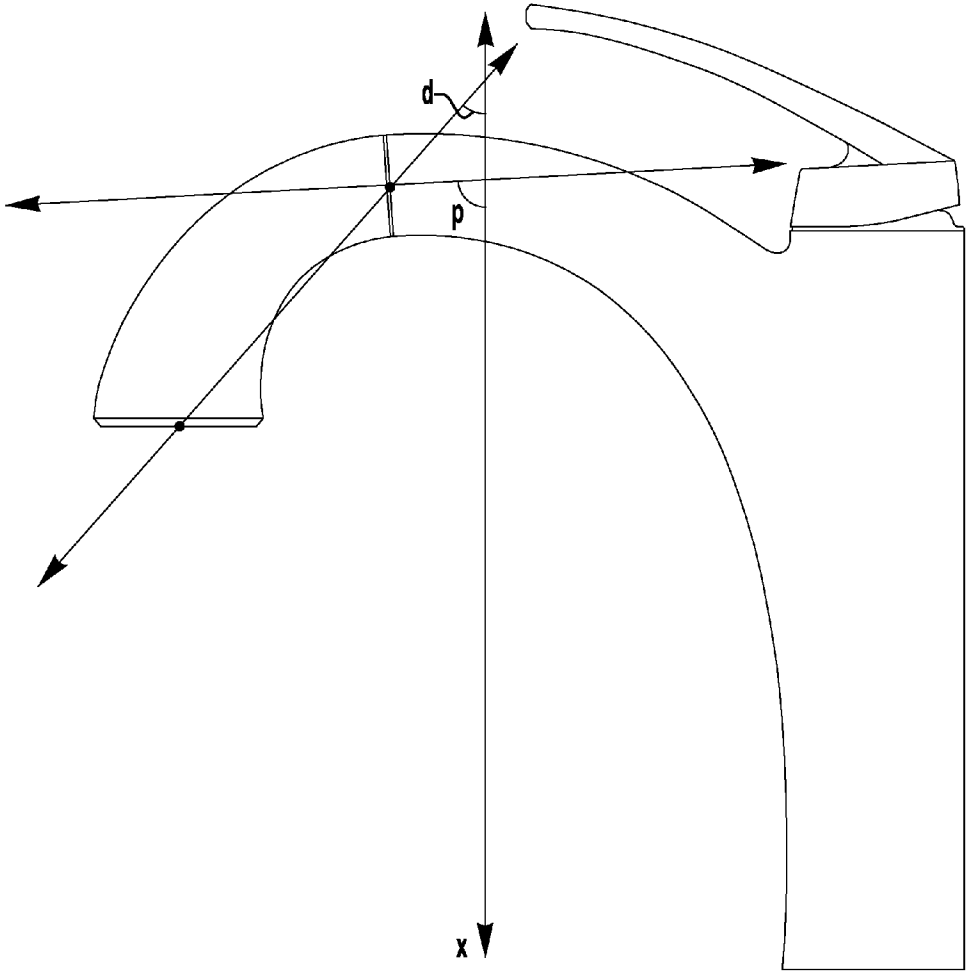
FIG. 15 is the side elevational view of FIG. 13 showing reference angles for a geometric orientation of the wand and/or a geometric relationship between components of the faucet.

Reference points and angles that will be used to define a geometric orientation of the wand 22 and/or a geometric relationship between components of the faucet are shown in FIGS. 2-3, 5-6, 8-9, 11-12, and 14-15.

As used herein, the following phrases have the following meaning as described with reference to FIGS. 2-3, 5-6, 8-9, 11-12, and 14-15:

"center point of base of hub" means a point of intersection between: (1) a plane extending through the mounting surface, and (2) a vertical line extending equidistant between: (a) a first vertical line extending through a leftmost horizontal point of the hub 12 at an interface between the hub 12 and the mounting surface, and (b) a second vertical line extending through a rightmost horizontal point of the hub 12 at the interface between the hub 12 and the mounting surface; the center point of the base of the hub is referenced as origin (0, 0) in FIGS. 2, 5, 8, 11, and 14;

"center point of outlet" means a point of intersection between: (1) a plane extending through an outermost portion of the spray face 16; if no portion of the spray face 16 is visible from outside the wand 22, the center point of the outlet is determined using a plane extending through an outermost portion of the wand 22, and (2) a vertical line extending equidistant between: (a) a first vertical line extending through a leftmost horizontal point of the downstream end of the wand 22, and (b) a second vertical line extending through a rightmost horizontal point of the downstream end of the wand 22; regardless of whether there is a single outlet or a plurality of outlets, the center point of the outlet is determined in the same manner; the center point of the outlet is referenced as point ($x_o$, $y_o$) in FIGS. 2, 5, 8, 11, and 14;

"center point of receptor/wand interface" means a point of intersection between: (1) a plane extending through the interface 24 between the receptor 20 and the wand 22, and (2) a horizontal line extending equidistant between: (a) a first horizontal line extending through an uppermost vertical point of the interface 24 between the receptor 20 and the wand 22, and (b) a second horizontal line extending through a lowermost vertical point of the interface 24 between the receptor 20 and the wand 22; the center point of the receptor/wand interface is referenced as point ($x_r$, $y_r$) in FIGS. 2, 5, 8, 11, and 14;

"central axis of receptor at receptor/wand interface" means an axis extending through a central point of the receptor 20 at the interface 24 between the receptor 20 and the wand 22; if the receptor 20 is generally straight, the central axis of the receptor at the receptor/wand interface will be the same as the central longitudinal axis of the receptor 20; if the receptor 20 is curved, the central axis of the receptor at the receptor/wand interface will not be the same as the central longitudinal axis of the receptor 20;

"highest point of spout" means a highest vertical point on a top surface of the receptor 20 and a top surface of the wand 22; the highest point of the spout is referenced as point ($x_s$, $y_s$) in FIGS. 2, 5, 8, 11, and 14; and "lowest point of base of handle" means a lowest vertical point on a bottom surface of the base of the handle 18 when the handle 18 is in a midmix position for temperature and an off position for volume; in certain embodiments, there are a plurality of points at the lowest vertical point and any of these points is the lowest point of the base of the handle; the lowest point of the base of the handle is referenced as point ($x_h$, $y_h$) in FIGS. 2, 5, 8, 11, and 14.

Additionally, as used herein, the following phrases have the following meaning as described with reference to FIGS. 2-3, 5-6, 8-9, 11-12, and 14-15 and the above:

"angle of docked wand" means an angle between: (1) a line extending through the center point of the receptor/wand interface and the center point of the outlet when the wand 22 is docked in the receptor 20, and (2) a vertical line; the angle of the docked wand is referenced as angle d in FIGS. 3, 6, 9, 12, and 15;

"angle of wand pull" means an angle between: (1) an axis along which the wand 22 is pulled in order to undock the wand 22 from the receptor 20 when the wand 22 is being pulled away from the receptor 20 along a path that is generally coaxial with the central axis of the receptor at the receptor/wand interface, and (2) a vertical line; the angle of the wand pull is referenced as angle p in FIGS. 3, 6, 9, 12, and 15;

"direction of docked wand" means a direction in which the wand 22 is oriented when the wand 22 is docked in the receptor 20;

"direction of wand pull" means a direction in which the wand 22 is pulled in order to undock the wand 22 from the receptor 20 when the wand 22 is being pulled away from the receptor 20 along a path that is generally coaxial with the central axis of the receptor at the receptor/wand interface;

"horizontal length of outlet" means the distance in the x direction between the center point of the base of the hub and the center point of the outlet;

"horizontal length of receptor" means a distance in the x direction between the center point of the base of the hub and the center point of the receptor/wand interface;

"vertical height of base of handle" means a distance in the y direction between the center point of the base of the hub and the lowest point of the base of the handle;

"vertical height of outlet" means a distance in the y direction between the center point of the base of the hub and the center point of the outlet; and "vertical height of spout" means a distance in the y direction between the center point of the base of the hub and the highest point of the spout.

In an exemplary embodiment, there is a relationship between the interface 24 between the receptor 20 and the wand 22, the angle of the wand pull, and the angle of the docked wand. In a further exemplary embodiment, the interface 24 between the receptor 20 and the wand 22 is between the highest point of the spout and the downstream end of the spout 14, the angle of the wand pull is less than ninety degrees (90°), and the angle of the docked wand is greater than thirty degrees (30°). In a further exemplary embodiment, the angle of the wand pull is less than eight-five degrees (85°) and the angle of the docked wand is greater than thirty degrees (30°). In a further exemplary embodiment, the angle of the wand pull is less than ninety degrees (90°) and the angle of the docked wand is greater than thirty-five degrees (35°). In a further exemplary embodiment, the angle of the wand pull is less than eight-five degrees (85°) and the angle of the docked wand is greater than thirty-five degrees (35°).

In an exemplary embodiment, there is a relationship between the interface 24 between the receptor 20 and the wand 22, the angle of the wand pull, and the angle of the docked wand. In a further exemplary embodiment, the interface 24 between the receptor 20 and the wand 22 is between the highest point of the spout and the downstream end of the spout 14, the angle of the wand pull is greater than sixty degrees (60°), and the angle of the docked wand is less than sixty degrees (60°). In a further exemplary embodiment, the angle of the wand pull is greater than sixty-five degrees (65°) and the angle of the docked wand is less than sixty degrees) (60°). In a further exemplary embodiment, the angle of the wand pull is greater than sixty degrees (60°) and the angle of the docked wand is less than fifty-five degrees (55°). In a further exemplary embodiment, the angle of the wand pull is greater than sixty-five degrees (65°) and the angle of the docked wand is less than fifty-five degrees (55°).

In an exemplary embodiment, there is a relationship between the angle of the wand pull and the angle of the docked wand. In a further exemplary embodiment, the angle of the wand pull is less than ninety degrees (90°) and greater than sixty degrees (60°) and the angle of the docked wand is less than sixty degrees (60°) and greater than thirty degrees (30°). In a further exemplary embodiment, the angle of the wand pull is less than eight-five degrees (85°) and greater than sixty-five degrees (65°) and the angle of the docked wand is less than sixty degrees (60°) and greater than thirty degrees (30°). In a further exemplary embodiment, the angle of the wand pull is less than ninety degrees (90°) and greater than sixty degrees (60°) and the angle of the docked wand is less than fifty-five degrees (55°) and greater than thirty-five degrees (35°). In a further exemplary embodiment, the angle of the wand pull is less than eight-five degrees (85°) and greater than sixty-five degrees (65°) and the angle of the docked wand is less than fifty-five degrees (55°) and greater than thirty-five degrees (35°).

In an exemplary embodiment, there is a relationship between the connection of the handle 18 and the hub 12, the interface 24 between the receptor 20 and the wand 22, and the angle of the wand pull. In a further exemplary embodiment, the handle 18 is operable to connect to the top of the hub 12, the interface 24 between the receptor 20 and the wand 22 is between the highest point of the spout and the downstream end of the spout 14, and the angle of the wand pull is less than ninety degrees (90°). In a further exemplary embodiment, the angle of the wand pull is less than eight-five degrees (85°).

In other exemplary embodiments, in combination with any of the embodiments regarding the relationship between the angle of the wand pull and/or the angle of the docked wand, there is a relationship regarding the vertical height of the spout. More specifically, the vertical height of spout is less than thirteen inches (13 in).

In other exemplary embodiments, in combination with any of the embodiments regarding the relationship between the angle of the wand pull and/or the angle of the docked wand, there is a relationship between the vertical height of the base of the handle and the vertical height of the outlet. More specifically, the vertical height of the base of the handle is greater than two-thirds (0.67) of the vertical height of the outlet.

In other exemplary embodiments, in combination with any of the embodiments regarding the relationship between the angle of the wand pull and/or the angle of the docked wand, there is a relationship between the vertical height of the base of the handle and the vertical height of the spout. More specifically, the vertical height of the base of the handle is greater than two-fifths (0.4) of the vertical height of the spout.

In other exemplary embodiments, in combination with any of the embodiments regarding the relationship between the angle of the wand pull and/or the angle of the docked wand, there is a relationship between the horizontal length of the receptor and the horizontal length of the outlet. More specifically, the horizontal length of the receptor is less than three-fourths (0.75) of the horizontal length of the outlet.

In other exemplary embodiments, in combination with any of the embodiments regarding the relationship between the angle of the wand pull and/or the angle of the docked wand, after being pulled away from the receptor 20, the wand 22 is operable to return to the receptor 20 with a force that is less than a force provided by a retraction mechanism.

In an exemplary embodiment, there is a relationship between the direction of the wand pull, the vertical height of the base of the handle, and the vertical height of the outlet. In a further exemplary embodiment, the direction of the wand pull is downward and the vertical height of the base of the handle is greater than two-thirds (0.67) of the vertical height of the outlet.

In an exemplary embodiment, there is a relationship between the direction of the wand pull, the vertical height of the base of the handle, and the vertical height of the spout. In a further exemplary embodiment, the direction of the wand pull is downward and the vertical height of the base of the handle is greater than two-fifths (0.4) of the vertical height of the spout.

In an exemplary embodiment, there is a relationship between the direction of the wand pull, the horizontal length of the receptor, and the horizontal length of the outlet. In a further exemplary embodiment, the direction of the wand pull is downward and the horizontal length of the receptor is less than three-fourths (0.75) of the horizontal length of the outlet.

In other exemplary embodiments, any of the above embodiments include structural features in a faucet body and/or a wand hose assembly that improve the usability of the wand. More specifically, at least one of the faucet body and the wand hose assembly includes structure that enables the wand to be moved from a docked position to an undocked position and pulled away from the faucet body with a force that is consistently low from a point of undocking through a distance of at least four inches (4 in) from the docked position. Additionally, at least one of the faucet body and the wand hose assembly includes structure that enables the wand to be returned to the faucet body from the distance of at least four inches (4 in) from the docked position to a distance of five-eighths of an inch (0.625 in) from the docked position with a force that is less than a force provided by a retraction mechanism. These structural features are described and shown in detail in U.S. Non-Provisional application Ser. No. 13/457,387, filed Apr. 26, 2012, titled Faucet With Wand, the entire disclosure of which is hereby incorporated by reference. Some of the exemplary embodiments having the geometrical orientation of the wand and/or the geometrical relationship between components of the faucet described above help facilitate the structural features described and shown in application Ser. No. 13/457,387 to allow for yet improved wand usability.

One of ordinary skill in the art will now appreciate that the present invention provides a faucet with a wand that has a geometric orientation of the wand and/or a geometric relationship between components of the faucet. Although the present invention has been shown and described with reference to a particular embodiment, equivalent alterations and modifications will occur to those skilled in the art upon reading and understanding this specification. The present invention includes all such equivalent alterations and modifications.

What is claimed is:

1. A faucet, comprising:

a hub, the hub being operable to connect to a mounting surface;

a spout, the spout including a receptor and a wand, the receptor being operable to connect to a side of the hub, the wand being operable to mount in the receptor, the wand being operable to pull away from the receptor, the spout having an upstream end, a downstream end, and a highest point between the upstream end and the downstream end, the spout having an interface between the receptor and the wand, the interface being between the highest point of the spout and the downstream end of the spout, the interface having a center point, the center point of the interface being lower than the highest point of the spout, the receptor extending outwardly from the side of the hub along a curve, the receptor extending upwardly from the side of the hub toward the highest point of the spout, the receptor extending downwardly from the highest point of the spout toward the interface between the receptor and the wand;

an outlet, the outlet being operable to deliver water from the wand, the outlet having a center point, the center point of the outlet being lower than the highest point of the spout, the center point of the outlet being lower than the center point of the interface; and a handle, the handle being operable to connect to a top of the hub, the handle being operable to move relative to the hub.

2. The faucet of claim 1, wherein:

an angle of wand pull is less than ninety degrees; and an angle of docked wand is greater than thirty degrees.

3. The faucet of claim 2, wherein the angle of wand pull is less than eighty-five degrees.

4. The faucet of claim 2, wherein the angle of docked wand is greater than thirty-five degrees.

5. The faucet of claim 1, wherein:

an angle of wand pull is greater than sixty degrees; and an angle of docked wand is less than sixty degrees.

6. The faucet of claim 5, wherein the angle of wand pull is greater than sixty-five degrees.

7. The faucet of claim 5, wherein the angle of docked wand is less than fifty-five degrees.

8. The faucet of claim 1, wherein:

an angle of wand pull is less than ninety degrees and greater than sixty degrees; and an angle of docked wand is less than sixty degrees and greater than thirty degrees.

9. The faucet of claim 8, wherein the angle of wand pull is less than eighty-five degrees and greater than sixty-five degrees.

10. The faucet of claim 8, wherein the angle of docked wand is less than fifty-five degrees and greater than thirty-five degrees.

11. The faucet of claim 1, wherein an angle of wand pull is less than ninety degrees.

12. The faucet of claim 11, wherein the angle of wand pull is less than eighty-five degrees.

13. The faucet of claim 1, wherein a vertical height of the spout is less than thirteen inches.

14. The faucet of claim 1, wherein a vertical height of a base of the handle is greater than two-thirds of a vertical height of the outlet.

15. The faucet of claim 1, wherein a vertical height of a base of the handle is greater than two-fifths of a vertical height of the spout.

16. The faucet of claim 1, wherein a horizontal length of the receptor is less than three-fourths of a horizontal length of the outlet.

* * * * *